United States Patent [19]

Bull et al.

[11] Patent Number: 4,529,507

[45] Date of Patent: Jul. 16, 1985

[54] CAPRYL ALCOHOL FROTHER IN IRON ORE FLOTATION PROCESS

[75] Inventors: William R. Bull; David J. Spottiswood, both of Golden, Colo.

[73] Assignee: Union Camp Corporation, Wayne, N.J.

[21] Appl. No.: 601,000

[22] Filed: Apr. 16, 1984

[51] Int. Cl.[3] ..... B03D 1/14

[52] U.S. Cl. ..... 209/166; 252/61

[58] Field of Search ..... 209/166; 252/61

[56] References Cited

U.S. PATENT DOCUMENTS

| | | | |
|---|---|---|---|
| 2,371,292 | 3/1945 | Hoag | 209/166 |
| 2,904,177 | 9/1959 | Michal | 209/167 |
| 4,422,928 | 12/1983 | McGlothin et al. | 252/61 |

OTHER PUBLICATIONS

Froth Floatation–Feurstenau, 1962, p. 264, Am. Institute of Mining Metallurgical & Petr. Engr.

*Primary Examiner*—Bernard Nozick

*Attorney, Agent, or Firm*—Kane, Dalsimer, Kane, Sullivan and Kurucz

[57] ABSTRACT

Capryl alcohol is employed as a frother in the froth flotation of silica from iron ore.

12 Claims, 4 Drawing Figures

RECOVERY-GRADE CURVE FOR MARTITE-GOETHITE ORE

DIAGRAMMATIC FLOWSHEET OF FLOTATION SCHEME

GENERAL RELATION SHIP BETWEEN RECOVERY AND GRADE

RECOVERY-GRADE CURVE FOR MARTITE-GOETHITE ORE

RECOVERY-GRADE CURVE FOR MARTITE ORE

CAPRYL ALCOHOL FROTHER IN IRON ORE FLOTATION PROCESS

BACKGROUND OF THE INVENTION

1. Field of the Invention

The invention relates to froth flotation processes and more particularly relates to the use of capryl alcohol as a frother in an iron ore flotation process.

2. Brief Description of the Prior Art

The literature is replete with descriptions of froth flotation processes and their application to the processing of iron ore. Representative of such descriptions are those found in U.S. Pat. No. 4,319,987; and the Tilden Mine–A New Processing Technique for Iron Ore, J. W. Villar and G. A. Dawe, Mining Congress J., October, 1975, 40–48.

In the Villar et al. article, there is a description of a froth flotation process developed for a large non-magnetic iron ore body located on the Marquette iron range in the upper peninsula of Michigan. The process was developed by the U.S. Bureau of Mines. Fine grinding of the ores to liberate the iron minerals from the siliceous gangue is followed by selective flocculation of the iron minerals. After desliming of dispersed fine silica, the remaining silica is removed by floating it with an ether amine cationic collector. The collector is adsorbed on the surface of the silica particles, thus making them hydrophobic and floatable. In this process, the collector apparently also functions as a frother or frothing agent since a separate frother is not used. A frother is a surface active agent which lowers the surface tension of the water to produce a semi-stable froth. A frother must give a froth above the pulp that is stable enough to prevent appreciable breakdown and subsequent return of particles to the pulp. However, once the froth is removed, it must break down readily to avoid problems in slurry pumping; see Introduction to Mineral Processing by Errol G. Kelly and David J. Spottiswood (1982), page 309.

Another important requirement in a frother is that it should not adsorb on mineral particles. If a frother were to act as a collector, the selectivity of the collector would be reduced. As noted above, some collectors do exhibit frothing properties. However, better plant control is obtained when the interaction of frother and collector are minimized as will be shown hereinafter.

The most widely used frothers are alcohols, especially methyl isobutyl carbinol, and glycol ethers. Capryl alcohol has been reported as a frother but, details are lacking as to where and how it has been used; see Froth Flotation, 50th Anniversary Volume, edited by D. W. Fuerstenau (1962) at p. 264.

We have found that in the froth flotation of iron ores to separate silica contaminants, capryl alcohol is an advantageous frother. Such ores may contain among other minerals, one or more of hematite, magnetite, limonite, siderite and turgite. Used in froth flotation systems where the collector is an ether amine, substantial reduction in the quantity of ether amine collector required for the process may be made. Replacement of 25% to 50% of the ether amine collector with capryl alcohol caused no significant change in metallurgical results. This represents a significant saving in reagent costs.

SUMMARY OF THE INVENTION

The invention comprises in a froth flotation process for separating silica from iron ore, which comprises frothing said ore in an aqueous medium in the presence of a silica collector, the improvement which comprises; generating froth with capryl alcohol.

Capryl alcohol (2-octanol) has the following structure:

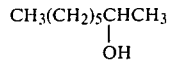

$$CH_3(CH_2)_5\underset{\underset{OH}{|}}{C}HCH_3$$

DETAILED DESCRIPTION OF THE PREFERRED EMBODIMENTS OF THE INVENTION

Figure 1:
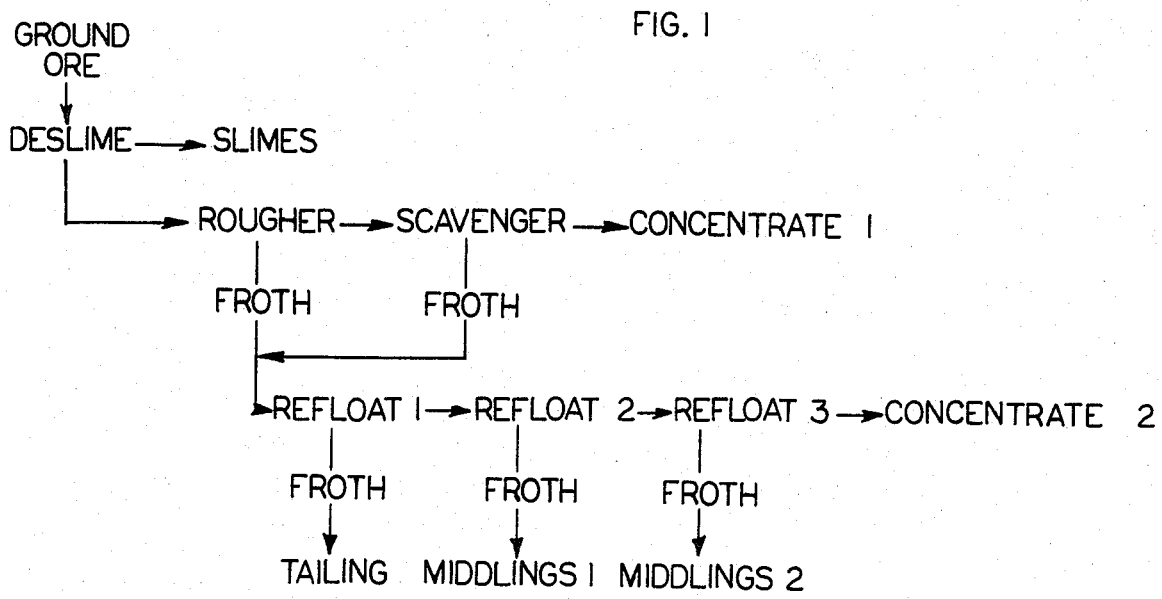
FIG. 1 is a diagrammatic flowsheet showing the steps carried out in an Example of the invention.

In carrying out the practice of this invention, the general well known technique of the froth flotation process is used. Briefly, the ore, or a concentrate of the ore, is ground and mixed with water to form a pulp. The pulp is placed in a suitable flotation cell or vessel provided with an agitator. Air is introduced into the pulp and passes through the pulp. The froth that is formed is skimmed off or allowed to overflow. The silica floats away with the froth, leaving the mineral concentrate behind. In this manner, the silica or siliceous material is separated from the desired mineral. This invention is particularly applicable in removing silica from iron ores containing the minerals martite, goethite, hematite, magnetite, limonite, siderite or turgite or mixtures thereof.

Mineral separation by froth flotation requires the use of chemical additives which can be categorized by function into three general types. They are: (1) the collector or flotation reagent which imparts the hydrophobicity to one mineral species, (2) the frother which lowers the aqueous surface tension to produce a semi-stable froth at the air-water interface, and (3) the modifiers or auxiliary reagents which are used to enhance the selective adsorption of the collector to a specific mineral surface and include, in the case of cationic silica flotation, depressants, dispersants, and pH regulators.

Sharp separations between the undesired silica mineral particles and the desired iron-containing mineral particles may not be obtained in a single stage of froth flotation. Thus, in commercial practice, to remove enough silica in the rougher flotation cells to achieve commercial purity iron ore concentrate in the underflow, considerable amounts of iron ore are also removed in the froth. Loss of this iron would make the process uneconomical. Thus, the froth product from the rougher flotation cells is usually subjected to several subsequent cleaner froth flotation stages to further separate the desired iron minerals from the undesired silica.

Details of carrying out the general procedure of froth flotation are well known and need not be recited herein. However, in the froth flotation of iron ores to separate silica, it has been a practice to employ a cationic collector, such as an ether amine of the formula:

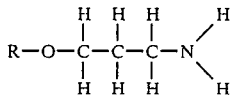

(I)

where R—O— is derived from a mixture of normal alcohols consisting predominantly of $C_8$ and $C_{10}$ carbon number alochols. In use, the amine is typically partially neutralized (~30%) with acetic acid to improve water dispersability.

The present invention is an improvement over the commonly practiced froth flotation process in that capryl alcohol is added to the aqueous pulping medium to generate froth, i.e., to function as a frother. In general, the capryl alcohol is added in a proportion sufficient to generate froth. Such a proportion may be within the range of from about 0.05 to 1.0 lbs/ton of ore, preferably 0.1 to 0.5 lbs/ton of ore.

The following Example describes the manner and process of making and using the invention and sets forth the best mode contemplated by the inventors for carrying out the invention.

EXAMPLE

Two iron ore samples, martite-goethite (blast pattern 277) and martite (blast pattern 537/591), were obtained from Cleveland-Cliffs Iron Company's Tilden Mine. Each sample had been crushed to minus 10 mesh and on receipt was mixed thoroughly and split into one kilogram lots. These were used as feed material for individual grinding, desliming and flotation tests.

FIG. 1 of the accompanying drawings is a diagrammatic flowsheet showing the steps carried out on the feed material. First, one kilogram of the ore feed material plus 650 ml water (containing 20–30 ppm of total carbonate) was ground in a Denver laboratory rod mill for 50 minutes, with added sodium hydroxide and sodium silicate. The mill was then washed with the same quality water into a 4 liter beaker. In each case, the ground ore was approximately 98% minus 400 mesh. In the deslime step the pulp was adjusted to the 4 liter mark with more prepared water. Caustic starch selective flocculant was added and the pulp was agitated gently by moving the slow-moving impeller up and down in the beaker for one minute. The iron ore particles were allowed to settle for five minutes and then suspended silica slimes were partly removed by siphoning to the 1 liter mark. Then more flocculant was added and the pulp was agitated gently with a wide blade spatula. After five minutes settling, a second slimes product was removed by siphoning to the 1 liter mark. The deslimed material was then subjected to froth flotation. The deslimed pulp was transferred to a 3 liter stainless steel flotation cell and agitated at 1200 rpm. Caustic starch (1.0 lb. per ton of ore) was added and the pulp was conditioned for three minutes. Then a commercially available linear $C_8/C_{10}$ oxypropyl amine (sold as Arosurf® MG 98 by Sherex Chemical Co. of Dublin, Ohio, a Division of Schering Co.), or alternatively, a blend of Arosurf MG 98 and capryl alcohol frother was added (at 0.15 lb. per ton of ore) and conditioned for three minutes more. The pH at this stage was 10.0. A rougher froth was then removed (floating virtually to completion) in about four minutes. A further 0.15 lb. per ton of ore of collector or collector-frother combination was then added, conditioned for three minutes, and a scavenger froth removed in a further three to four minutes. The pulp remaining in the cell after the scavenger float was filtered, dried and named "concentrate 1". The rougher and scavenger froths were combined and caustic starch (0.5 lb. per ton of ore) was added, conditioned for three minutes and a froth removed for four minutes. This froth was named "tailing". The unfloated material was conditioned for three minutes with collector or collector-frother combination (0.05 lb per ton of ore), and a froth removed for three minutes. This froth was named "middlings 1". The unfloated material was again conditioned for three minutes with collector or collector-frother combination (0.05 lb per ton of ore) and another froth removed for three minutes. This froth was named "middlings 2". The unfloated material was named "concentrate 2".

The above-described procedure was carried out a plurality of times, varying the amounts of collector and capryl alcohol employed, in a first series using the martite-goethite feed material. Each run of the procedure was identified with a test code letter (A–F). The entire series was then repeated, but using the martite feed ore.

The slimes, concentrates 1 and 2, tailings and middlings 1 and 2 are weighed and assayed for iron content. The actual head (iron ore feed) assays showed reasonably good agreement with the calculated head assays for the six flotation tests; see Table 1 below.

TABLE 1

Actual and Calculated Head Assays (Iron, %)

| Actual Head Assays | Martite-Goethite | Martite |
|---|---|---|
| Sample No. 1 | 36.0 | 35.7 |
| Sample No. 2 | 34.5 | 35.9 |

| Calculated Head Assays Test Code | Collector System: Arosurf MG98, % | Collector System: Capryl Alcohol, % | Ore: Martite-Goethite | Ore: Martite |
|---|---|---|---|---|
| A | 100 | 0 | 34.3 | 36.7 |
| B (duplicate of A) | 100 | 0 | 34.8 | 36.1 |
| C (triplicate of A) | 100 | 0 | 35.9 | 37.2 |
| D | 50 | 50 | 35.5 | 37.4 |
| E (duplicate of D) | 50 | 50 | 34.8 | 37.1 |
| F | 75 | 25 | 35.6 | 36.8 |

The calculated head assays were determined in each case as were the iron distribution or recovery (yield) values, based on the analysis made. Representative of the calculations reported is that made on Test Case A as follows:

TEST CODE A (100% AROSURF MG98) WITH THE MARTITE-GOETHITE ORE

| Product | Wt., % | Iron Content, % | Iron Distribution |
|---|---|---|---|
| Slimes | 17.8 | 23.3 | 12.1 |
| Concentrate 1 | 29.3 | 60.5 | 51.7 |
| Tailing | 40.6 | 14.2 | 16.8 |
| Middlings 1 | 2.3 | 27.5 | 1.9 |
| Middlings 2 | 1.2 | 43.8 | 1.5 |
| Concentrate 2 | 8.8 | 62.2 | 16.0 |

calculated head assay is given by:

$$\frac{(17.8 \times 23.3) + (29.3 \times 60.5) + (40.6 \times 14.2)}{100} +$$

-continued $$\frac{(2.3 \times 27.5) + (1.2 \times 43.8) + (8.8 \times 62.2)}{100} = 34.3\%$$

Iron distribution, for example in the slimes, is given by:

$$\frac{\text{Wt \% of slimes} \times \text{Iron content of slimes}}{\text{Calculated Head assay}} = \frac{17.8 \times 23.3}{34.3} = 12.1\%$$

It will be appreciated by those skilled in the art that the desliming step described above results in losses of iron, and in varying proportions in laboratory flotation studies. This was confirmed by assay of the deslimed materials in each of the runs A–F, for both series of feed materials. The assay results are shown below in Table 2

TABLE 2

DESLIMING OPERATION RESULTS

| Test Code | Collector System: Arosurf MG98, % | Collector System: Capryl Alcohol % | Wt % in Slimes | Assay of Slime Iron % | % of Iron in Ore Lost in Slimes |
|---|---|---|---|---|---|
| Martite-Goethite Ore | | | | | |
| A | 100 | 0 | 17.8 | 23.3 | 12.1 |
| B (duplicate of A) | 100 | 0 | 28.7 | 26.7 | 22.0 |
| C (triplicate of A) | 100 | 0 | 29.7 | 29.8 | 24.7 |
| D | 50 | 50 | 24.5 | 30.4 | 21.0 |
| E (duplicate of D) | 50 | 50 | 31.7 | 27.1 | 24.7 |
| F | 75 | 25 | 24.0 | 25.6 | 17.3 |
| Martite Ore | | | | | |
| A | 100 | 0 | 13.6 | 7.90 | 2.9 |
| B (duplicate of A) | 100 | 0 | 19.2 | 8.82 | 4.7 |
| C (triplicate of A) | 100 | 0 | 17.9 | 9.14 | 4.4 |
| D | 50 | 50 | 17.0 | 8.47 | 3.8 |
| E (duplicate of D) | 50 | 50 | 17.3 | 7.33 | 3.4 |
| F | 75 | 25 | 15.1 | 9.82 | 4.0 |

Because of varying proportions of iron lost in the slimes, it would not be correct to assess the effect of flotation reagents with respect to all of the iron in the ore, but only with respect to the iron remaining after the slimes have been removed. For each flotation test, A–F described above the significant results are, therefore, percentage recovery of iron in concentrates 1 and 2 from the iron remaining after desliming, plus the calculated grade of these two concentrates combined. An example of the calculations is shown for Run test Code A, on the martite-goethite ore as:

Recovery of iron in concentrates 1+2 after desliming is given by:

$$\frac{(\text{\% Iron distribution in concentrates } 1 + 2) \times 100}{100\% - \text{\% Iron in slimes}} = \frac{(51.7 + 16.0) \times 100}{100 - 12.1} = 77.0\%$$

Grade of iron in concentrates 1+2 is the weight average iron content, as follows:

$$\frac{(\text{Wt. \% of concentrate 1} \times \text{\% iron} + (\text{Wt. \% of concentrate 2} \times \text{\% iron})}{\text{Total Weight}} = \frac{(29.3 \times 60.5) + (8.8 \times 62.2)}{29.3 + 8.8} = 60.9\%$$

The calculated results for all of the test flotation runs are given in Tables 3 and 4 below. The results given in the Tables are graphically presented in the corresponding FIGS. 3 and 4, respectively, of the accompanying drawings.

TABLE 3

Recovery & Grade Results after Desliming of Martite-Goethite Ore

| Test Code | Collector System: Arosurf MG98, % | Collector System: Capryl Alcohol % | Recovery of Iron in Concentrates 1 + 2, % | Grade of Iron in Concentrates 1 + 2, % |
|---|---|---|---|---|
| A | 100 | 0 | 77.0 | 60.9 |
| B (duplicate of A) | 100 | 0 | 69.2 | 62.0 |
| C (triplicate of A) | 100 | 0 | 65.3 | 64.1 |
| D | 50 | 50 | 72.9 | 61.6 |
| E (duplicate of D) | 50 | 50 | 71.3 | 62.1 |
| F | 75 | 25 | 67.4 | 63.6 |

TABLE 4

Recovery & Grade Results after Desliming of Martite Ore

| Test Code | Collector System: Arosurf MG98, % | Collector System: Capryl Alcohol % | Recovery of Iron in Concentrates 1 + 2, % | Grade of Iron in Concentrates 1 + 2, % |
|---|---|---|---|---|
| A | 100 | 0 | 81.4 | 65.6 |
| B (duplicate of A) | 100 | 0 | 72.9 | 65.3 |
| C (triplicate of A) | 100 | 0 | 61.8 | 69.1 |
| D | 50 | 50 | 77.9 | 66.5 |
| E (duplicate of D) | 50 | 50 | 69.0 | 64.4 |
| F | 75 | 25 | 66.6 | 68.3 |

Figure 2:
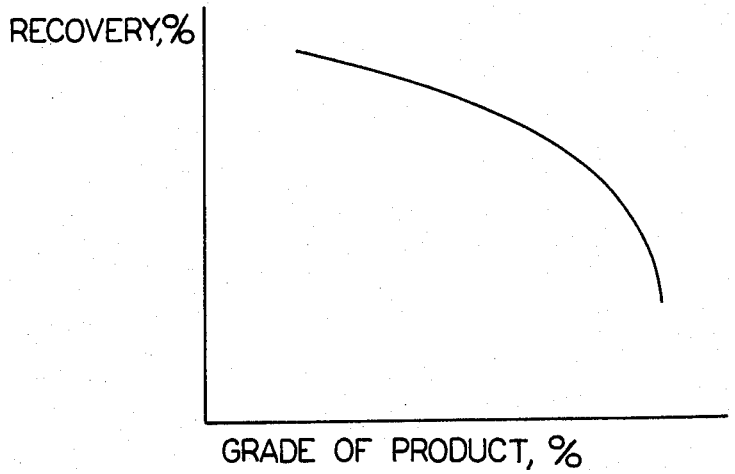
FIG. 2 is a graphical representation of the general relationship between the percentage of iron value recovery (yield) and the purity (grade) of the product recovered by froth flotation.

It will be appreciated that any ore can be treated in a variety of ways which are metallurgically equivalent. In the flotation process, for example, a typical result will have a certain percentage recovery and a corresponding grade (purity) of product. Another test, particularly in operator-sensitive systems, will give either a higher recovery and a lower grade of product or vice-versa. There is always an inverse relationship between recovery and grade that takes the general shape of the curve shown in FIG. 2 of the accompanying drawings. If results fall on the same recovery-grade curve, they are metallurgically equivalent, and slightly different operation could make the results practically identical.

Figure 3:
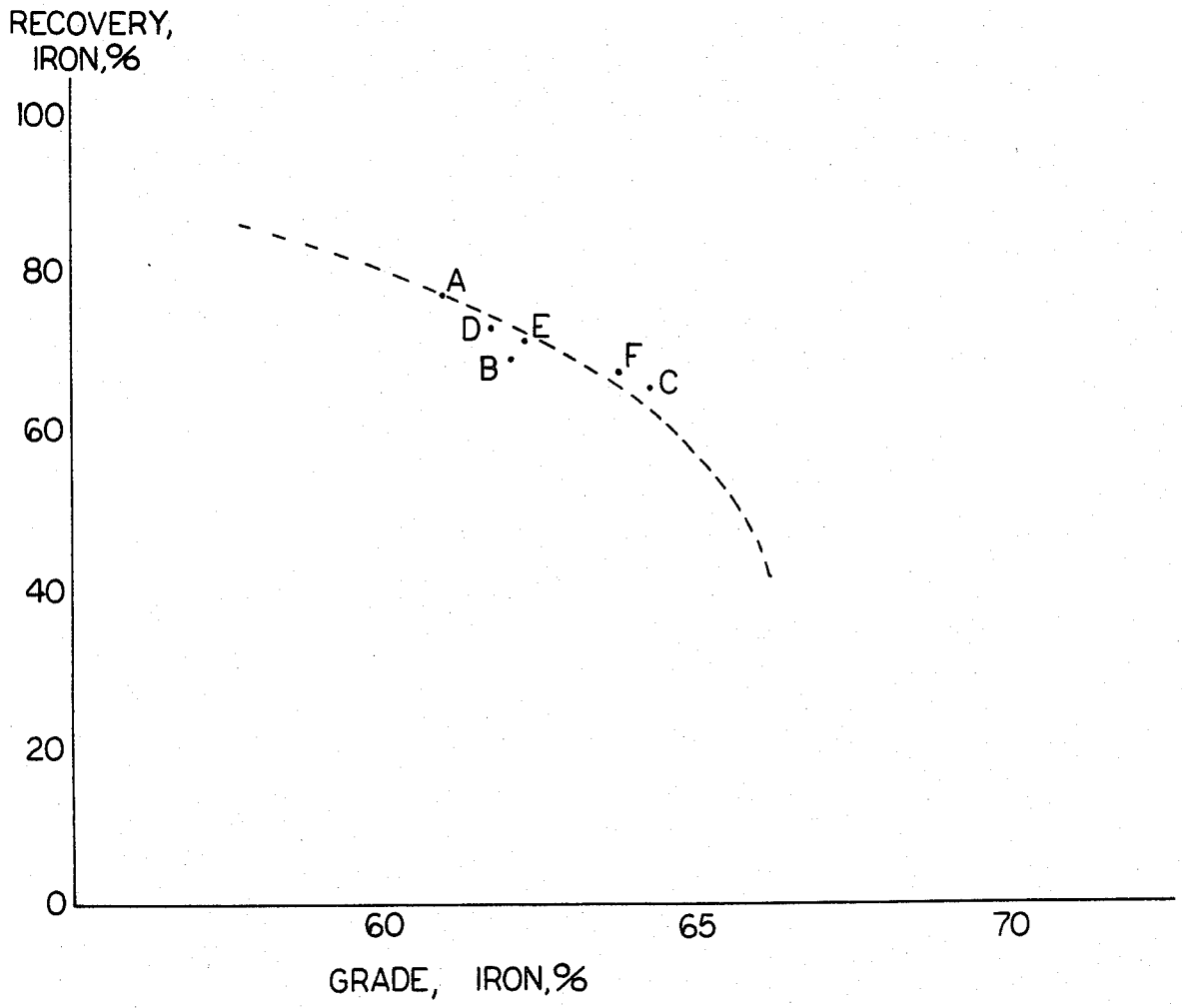
FIG. 3 is a graphical representation of the results given in Table 3.
Figure 4:
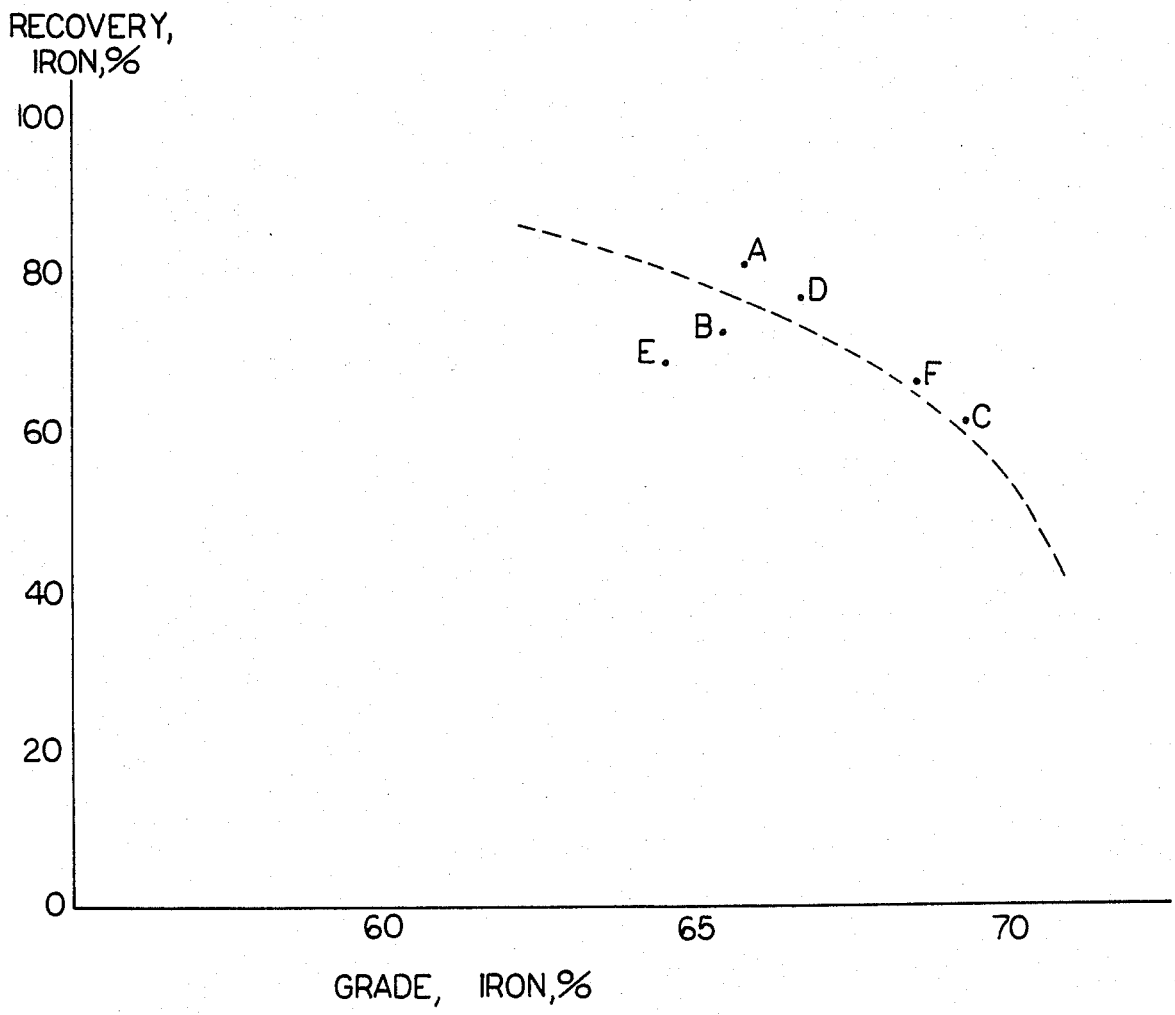
FIG. 4 is a graphical representation of the results given in Table 4.

As viewed in the FIGS. 3 and 4, for each ore, a reasonable recovery-grade curve is shown as a dotted line. Most of the points for the martite-goethite ore (FIG. 3) lie close to the dotted recovery-grade curve. The results for the martite ore show more scatter, but no trend. A reasonable interpretation of these data is that replacement of 25% to 50% of Arosurf MG98 with capryl alcohol frother has no significant effect on metallurgical performance of the flotation process. Because of its chemical structure, capryl alcohol must function as a frother, and not as a collector for silica. The successful replacement of a large proportion of the Arosurf MG98 collector with capryl alcohol frother strongly suggests that this collector functions partly as a frother. In general, it is undesirable for collectors to have frothing properties. Therefore, the use of capryl alcohol frother gives better control during flotation.

What is claimed:

1. In a froth flotation process for separating silica from iron ore, which comprises frothing said ore in an aqueous medium in the presence of a cationic silica collector selected from ether amines of the formula:

$$R—O—CH_2—CH_2—CH_2—NH_2$$

wherein R—O— is derived from a mixture of normal alcohols, consisting predominantly of $C_8$ and $C_{10}$ carbon number alcohols, the improvement which comprises; generating froth with capryl alcohol wherein the ratio of collector to frother is with in the range of 1 to 1 to 3 to 1, whereby the collector floats off the silica in the froth and the iron ore is obtained in the underflow.

2. The improved process of claim 1 wherein said collector is a mixture of ether amines.

3. The improved process of claim 1 wherein the ore contains martite.

4. The improved process of claim 1 wherein the ore contains goethite.

5. The improved process of claim 1 wherein the ore contains hematite.

6. The improved process of claim 1 wherein the ore contains magnetite.

7. The improved process of claim 1 wherein the ore contains limonite.

8. The improved process of claim 1 wherein the ore contains siderite.

9. The improved process of claim 1 wherein the ore contains turgite.

10. The improved process of claim 1 wherein the capryl alochol is added to the medium in a proportion of from about 0.05 to 1.0 lb/ton of ore.

11. The improved process of claim 1 wherein the ether amine is partially or totally neutralized with a solubilizing anion.

12. The improved process of claim 11 wherein the anion is acetate.

* * * * *